United States Patent [19]

Roller

[11] Patent Number: 5,048,817

[45] Date of Patent: Sep. 17, 1991

[54] DYNAMIC EDGE GUIDE FOR SIDE REGISTRATION SYSTEMS

[75] Inventor: George J. Roller, Penfield, N.Y.

[73] Assignee: Xerox Corporation, Stamford, Conn.

[21] Appl. No.: 425,158

[22] Filed: Oct. 23, 1989

[51] Int. Cl.[5] ..... B65H 9/16

[52] U.S. Cl. ..... 271/250

[58] Field of Search ..... 271/248, 250, 251, 230, 271/240, 198

[56] References Cited

U.S. PATENT DOCUMENTS

| | | | |
|---|---|---|---|
| 2,249,186 | 7/1941 | Spiess | 271/52 |
| 2,791,247 | 5/1957 | Gerson | 271/248 X |
| 3,062,538 | 11/1962 | Rutkus, Jr. et al. | 271/79 |
| 3,256,009 | 6/1966 | Reilly | 271/60 |
| 3,781,004 | 12/1973 | Baddendeck et al. | 271/10 |
| 3,908,986 | 9/1975 | Bleau | 271/227 |
| 3,915,447 | 10/1975 | Perno | 271/7 |
| 4,015,843 | 4/1977 | Tennant | 271/240 |
| 4,381,108 | 4/1983 | Newsome | 271/240 X |
| 4,487,407 | 12/1984 | Baldwin | 271/233 |
| 4,669,719 | 6/1987 | Fratangelo | 271/251 |

OTHER PUBLICATIONS

Xerox Disclosure Journal, vol. 1, No. 5, 5/76, pp. 85/86.

*Primary Examiner*—Richard A. Schacher
*Attorney, Agent, or Firm*—William A. Henry, II

[57] ABSTRACT

A dynamic edge guide for use in a side edge registration system includes a moving belt having raised ridges thereon that form a channel into which a substrate fits. Substrates moved through the registration system by a transport device are side registered against the belt by a scuffer mechanism with the transport device and belt moving at approximately the same speed. In this manner, adverse couple created between the side registration mechanism and the resisting frictional force between the paper and the registration guide is minimized.

8 Claims, 4 Drawing Sheets

DYNAMIC EDGE GUIDE FOR SIDE REGISTRATION SYSTEMS

BACKGROUND OF THE INVENTION

This invention relates to an electrophotographic printing machine, and more particularly concerns a dynamic edge guide for side edge copy registration systems in a printing machine.

A typical electrophotographic printing machine utilized in the business office environment contains stacks of cut sheets of paper on which copies of original documents are reproduced. Generally, these cut sheets of paper are advanced through the printing machine, one sheet at a time, for suitable processing therein. Frequently, papers are advanced through the printing machine by transport subsystems. These subsystems are those sections of the paper handling module which drive copy paper from one printing processing station to another. Copy paper is directed to and from various subsystems by baffles and/or selection gates. All transports are directly driven from the main power drive and become operational upon "print command." The gates are usually solenoid operated and direct the copy paper as required to meet user selected output requirements. Attempts are made to design each transport where possible to allow ready accessibility to the copy paper by untrained machine operators. Coin switches are located throughout the various transports to provide jam protection.

One of the existing and standard methods for deskewing and side registering substrates in a copier includes the use of ball-on-belt systems, scuffer wheels, crossed rolls and ball-on-roll systems. A ball-on-belt system is used with a lead edge timing scheme and allows the lead edge of a substrate, driven by the belt, to be timed into a set of take away rolls so that the substrate reaches the transfer station in synchronism with a particular image on the photoreceptor. Some of the problems associated with this type of lead edge and side registration system encompasses mechanical drives for deskewing and shift registration and take away pinch roll drives. In addition, damage to copy substrates including jamming is possible due to crumpling, or counter clockwise rotation about the lead, registration guide, corner of the substrates. This is due to the adverse couple created between side registration mechanisms and the resisting frictional force between the substrate and the registration guide.

PRIOR ART STATEMENT

Various other methods have been used to transport and register substrates with the following prior art appearing relevant: G. Spiess, U.S. Pat. No. 2,249,186, issued Jul. 15, 1941; J. Rutkus, Jr. et al., U.S. Pat. No. 3,062,538, issued Aug. 1, 1960; R. Reilly, U.S. Pat. No. 3,256,009, issued Dec. 23, 1963; G. Buddendeck, U.S. Pat. No. 3,781,004, issued Dec. 25, 1973; C. Bleau, U.S. Pat. No. 3,908,986, issued Sept. 30, 1975; B. Perno, U.S. Pat. No. 3,915,447, issued Oct. 28, 1975, L. Baldwin, U.S. Pat. No. 4,487,407, issued Dec. 11, 1984; and Xerox Disclosure Journal, Vol. 1, No. 5, May 1976, page 85. The pertinent portions of the foregoing prior art may be summarized as follows:

Spiess discloses a system for transverse feeding of sheets or the like by the use of a transverse conveying table and press bodies, i.e., balls, brushes or rollers, or the like.

Rutkus et al. shows grippers that hold sheets on a chain conveyor for movement through copier processing stations.

Reilly discloses a sheet registration device that arrests and aligns each individual sheet during travel and then in timed relation to the movement of the photoreceptor advances the sheet into engagement with the photoreceptor in registration with a previously formed xerographic image on the photoreceptor.

Buddendeck shows two conveyor systems from supply to output with each traveling at a different speed and a switching device arranged between the conveying devices operatively connected to a time sequence programming system which controls the feeding of sheets from a supply to the first conveying system.

Bleau discloses a sheet aligning mechanism which urges sheets by the use of a feed roll and a cooperating pinch member into both a leading edge aligner and a side edge aligner.

Perno shows a sheet handling apparatus that includes a movable belt which has multiple tabs extending therefrom. The tabs are adapted for deskewing and registering the lead edge of a sheet presented thereto, the tabs thereafter being forced into contact with the lead edge of the sheet to grip the sheet for subsequent conveyance.

Baldwin is directed to a trail edge registration system that includes a feed belt that has fingers extending up from the belt for capturing the trail edge of a sheet supply the timing as well as deskew function for the system.

Looney discloses in his Xerox Disclosure Journal publication a sheet registration system for providing front edge registration in space and time for a sheet while the sheet is moving.

Other patents of interest include U.S. Pat. No. 3,596,902 which discloses a printing press nonstop side register mechanism which uses a registration belt that moves at the same speed as a sheet to prevent misregistration. The side guide mechanism includes apparatus to engage the side edge of the sheet as the sheet is being conveyed across a feed board. A method and apparatus for registering sheets that uses a registration belt which moves at the same speed as a conveyor belt and is also movable laterally is shown in U.S. Pat. No. 4,572,499. A means is provided to move a sheet over to an edge guide using a belt. U.S. Pat. No. 4,767,116 discloses a page straightener which uses two laterally movable belts to align sheets of paper on a conveyor belt. A means is provided to drive a registration belt at the same speed as a conveyor belt. Side registration of a moving sheet against a registration bar is shown in U.S. Pat. No. 4,836,527 that is accomplished by a roll nip that is slightly angled toward the registration line, and is thereafter self-pivotable from that angle to one angle nearly in alignment with the direction of sheet travel.

SUMMARY OF THE INVENTION

In accordance with the present invention, there is provided a dynamic edge guide for use in a side edge copy sheet registration system. It includes an improvement over the above mentioned registration systems and comprises a moving registration guide such as a belt, which effectively guides a substrate to an edge guide coefficient of friction to 0 by essentially eliminating the relative motion between copy sheets and the edge guide.

BRIEF DESCRIPTION OF THE DRAWING

Other features of the present invention will become apparent as the following description proceeds and upon reference to he drawings in which.

While the present invention will be described hereinafter in connection with a preferred embodiment thereof, it will be understood that it is not intended to limit the invention to that embodiment. On the contrary, it is intended to cover all alternatives, modifications, and equivalents as may be included with the spirit and scope of the invention as defined by the appended claims.

Figure 1:
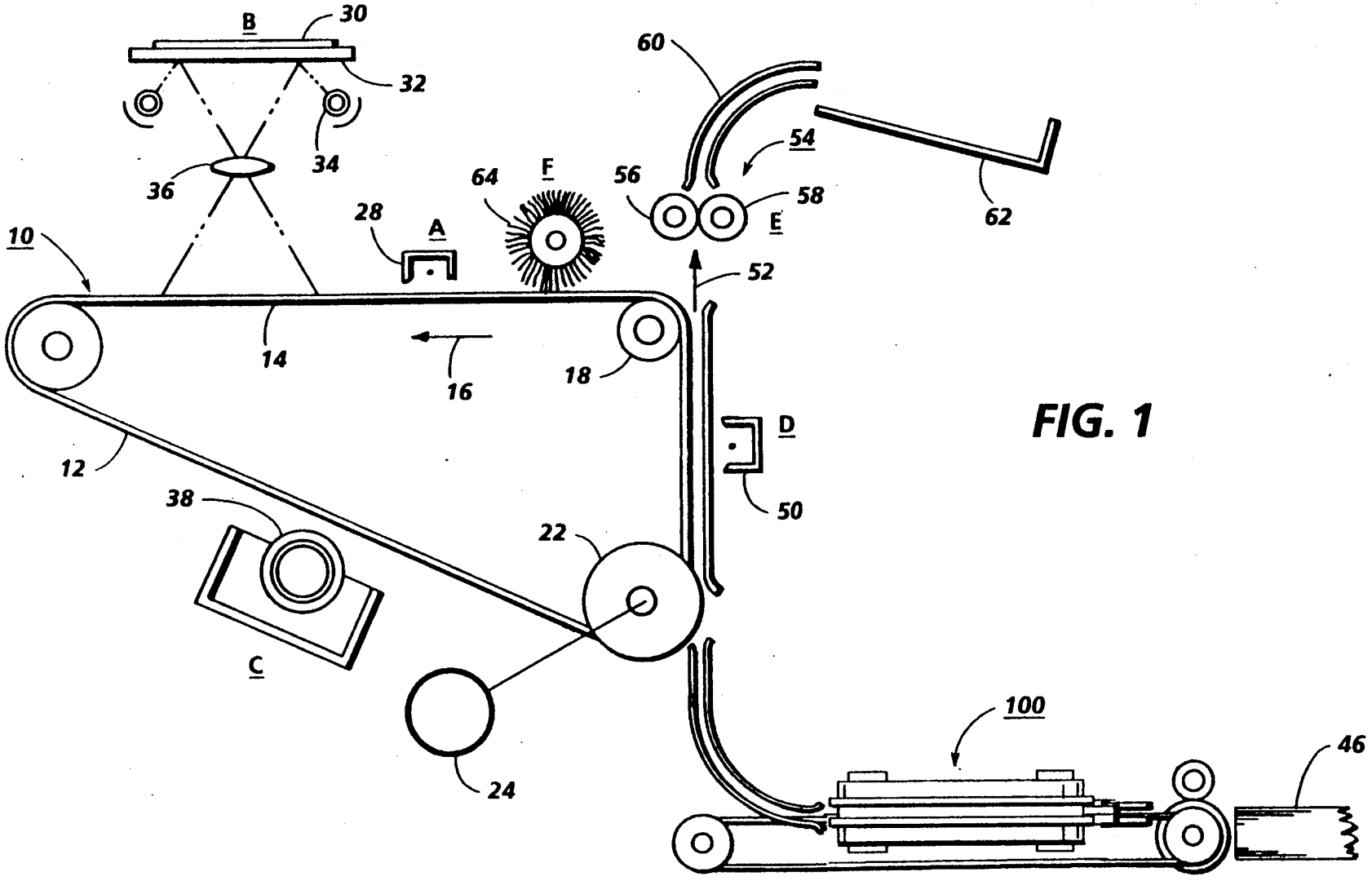
FIG. 1 is a schematic elevational view of an electrophotographic printing machine incorporating the features of the dynamic sheet edge guide of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the dynamic edge guide of the present invention therein. It will become evident from the following discussion that the dynamic edge guide disclosed herein is equally well suited for use in a wide variety of devices and is not necessarily limited to its application to the particular embodiment shown herein. For example, the apparatus of the present invention may be readily employed in document handlers, non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Belt 10 is maintained in tension by a pair of springs (not shown), resiliently urging tension roller 22 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a conventional corona generating device, indicated generally by the reference numeral 28, charges photoconductor surface 12 of the belt 10 to a relatively high, substantially uniform potential.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet of support material is advanced toward transfer station D by trail edge registration device 42. Preferably, the registration device 42 includes pinch rolls 70 and 71 which rotate so as to advance the uppermost sheet feed from stack 46 into transport belts 48 and 49. The transport belts direct the advancing sheet of support material into contact with the photoconductive surface 12 of belt 10 in a timed sequence so that the toner powder image developed thereon synchronously contacts the advancing sheet of support material at transfer station D.

Transfer station D includes a corona generating device 50 which sprays ions into he backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the sheet support material is separated from the photoconductive surface 12 of belt 10, some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brushy 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrostatographic printing machine.

Figure 2:
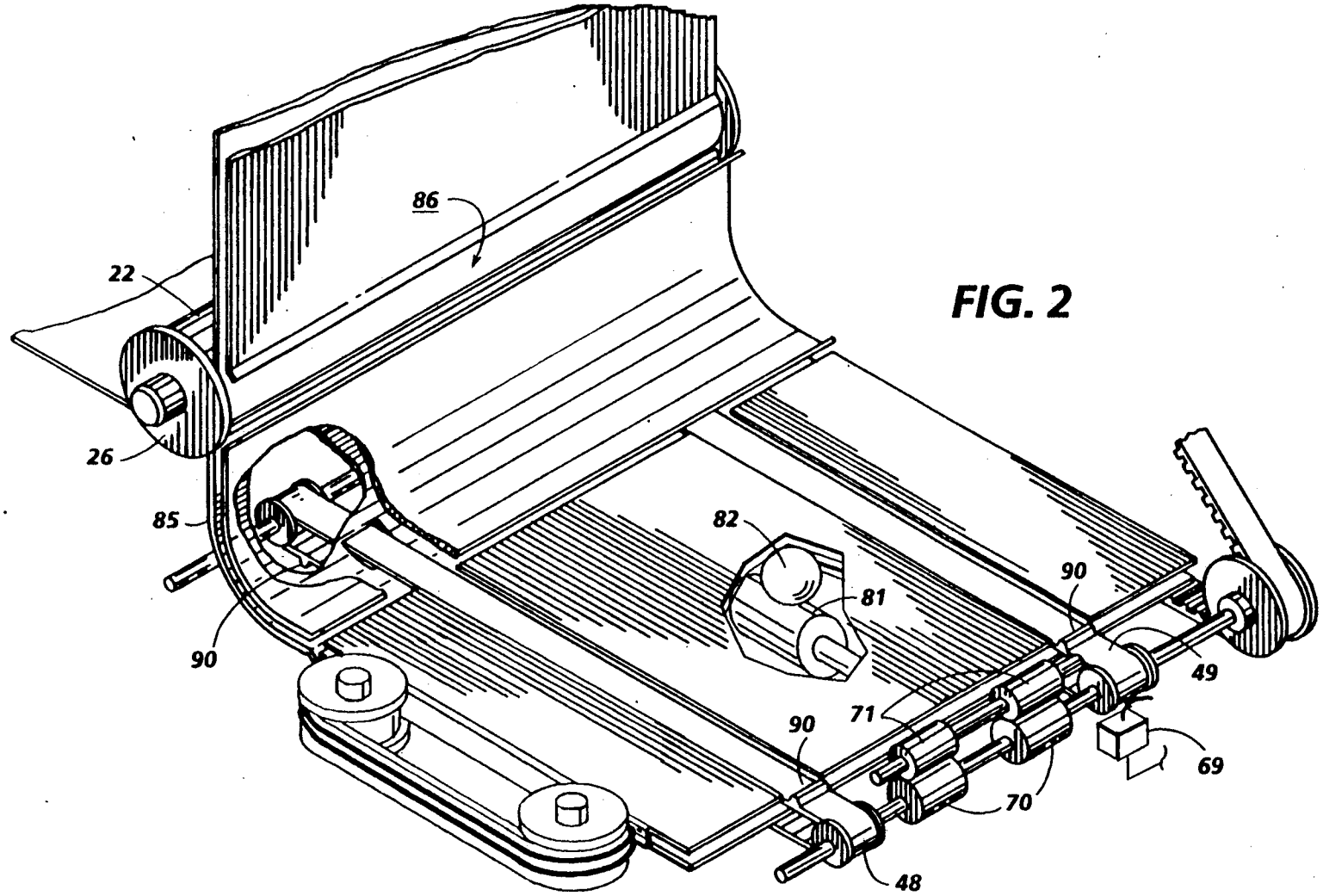
FIG. 2 is a partially exploded schematic of the apparatus of the present invention.

Referring now to the specific subject matter of the present invention, FIG. 2 shows a scuffer roll side registration and finger-on-belt trail edge timing concept that includes a dynamic edge guide 100. A substrate enters the registration subsystem positively driven by opposing pairs of pinch rolls 70 and 71. When the substrate trail edge passes through the nip formed between pinch rolls 70 and 71, it is driven toward, and side registered against, dynamic edge guide 100 by scuffer roll 81 and ball 82. At this time, fingers 90 attached or molded into belts 48 and 49 come around and contact the trail edge of the substrate or paper thereby both transporting the paper and supplying the timing function and deskewing function, i.e., synchronizing the substrate with a specific, repeatable location of the photoreceptor (onto which the image can be placed). While the fingers are shown here equidistant from each other on belts 48 and 49, it should be understood that one finger on each belt will work as will three or more on each belt. A baffle 85 consisting of parallel surfaces approximately 3 mm apart guides the substrate into the xerographic transfer zone 86. The tacking forces of transfer slightly overdrive the substrate pulling it away and thus uncoupling it from the forward drive of fingers 90.

In addition to supplying the machine configurational flexibility of a trail edge option, trail edge registration combines the timing and transport function and thereby reduces cost. Other advantages of trail edge registration include precise directional control of the lead edge of the substrate at the entrance to transfer and providing of a reliable means of uncoupling the timing drive from the photoreceptor/transfer drive.

Figure 3:
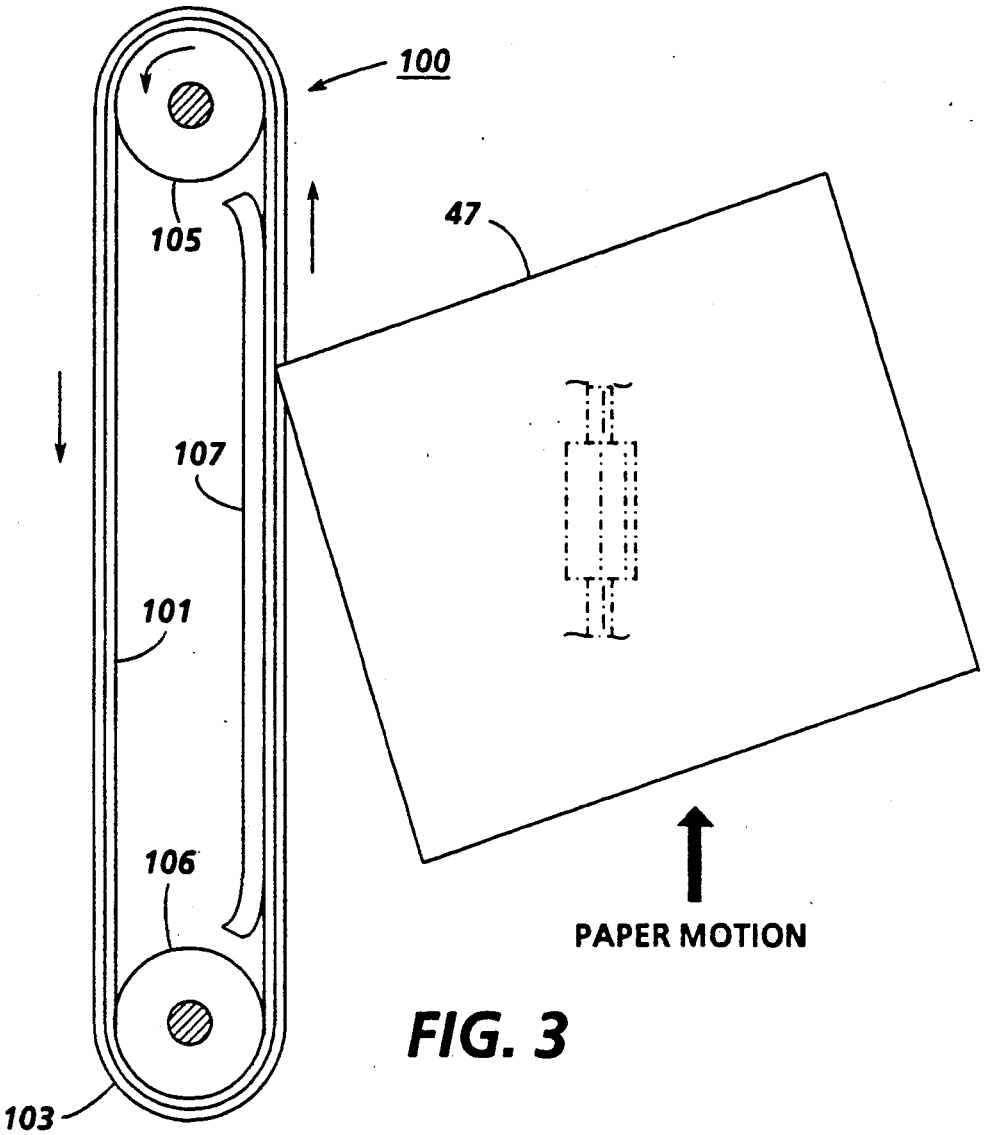
FIG. 3 is a partial top view of the dynamic edge guide of FIG. 1.
Figure 4:
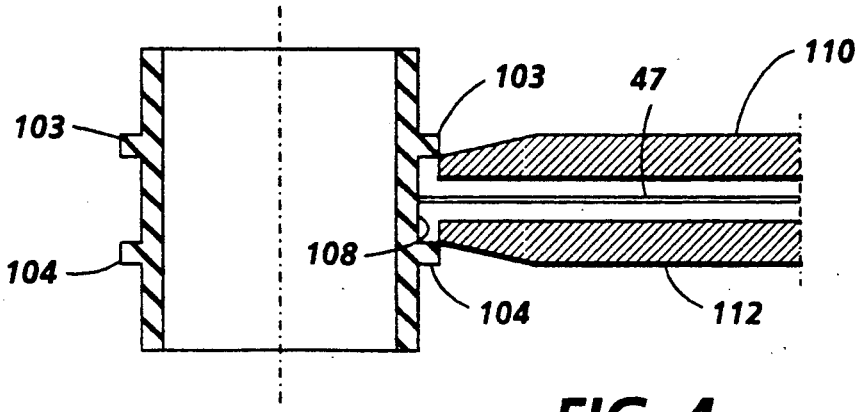
FIG. 4 is a partial end view of the dynamic edge guide of FIG. 3.

The dynamic edge guide technique employed in the registration system of the present invention and shown in FIGS. 3 and FIG. 4 comes into play as a substrate 47 is positively driven from tray 45 by pinch rolls 70 and 71. The lead edge of the substrate passes between scuffer member 81, and normal force ball 82 before the trail edge of the substrate leaves the pinch rolls. When the trail edge of the substrate exits the pinch rolls, it is driven sideways and registered against moving edge guide or belt 101. The uniqueness of the moving guide solves two problems associated with edge guides in the past. First, the "couple" between the side registration mechanism, the edge side and substrate is eliminated and second, the problem of edge guide wear is eliminated because the substrate is remaining at the same speed as the belt thereby eliminating friction that would be created if the belt were a stationary edge guide. Finger 90 comes into contact with the trail edge of the substrate and drives it forward. By moving edge guide 101, the substrate-to-edge guide coefficient of friction is effectively 0. As seen in FIGS. 3 and 4, moving edge guide 100 includes a belt 101 entrained around a drive member 105 and idler member 106. Belt 101 has ridges 103 and 104 thereon that form a U-shaped channel within which substrates 47 travel. Baffles 110 and 112 are provided to insure that substrates 47 are directed into channel 108 of belt 101. A belt locking support plate 107 maintains positive side edge registration with the contact edge of substrate 47.

In this exemplary apparatus, the image on the photoreceptor is synchronized with the location of the copy paper by adjusting flash time. This is done by fingers 90 tripping a switch 69 which initiates a flash or exposure sequence. This sequence includes a reverse countdown until flash. Synchronization is achieved by adjusting the time.

Figure 3A:
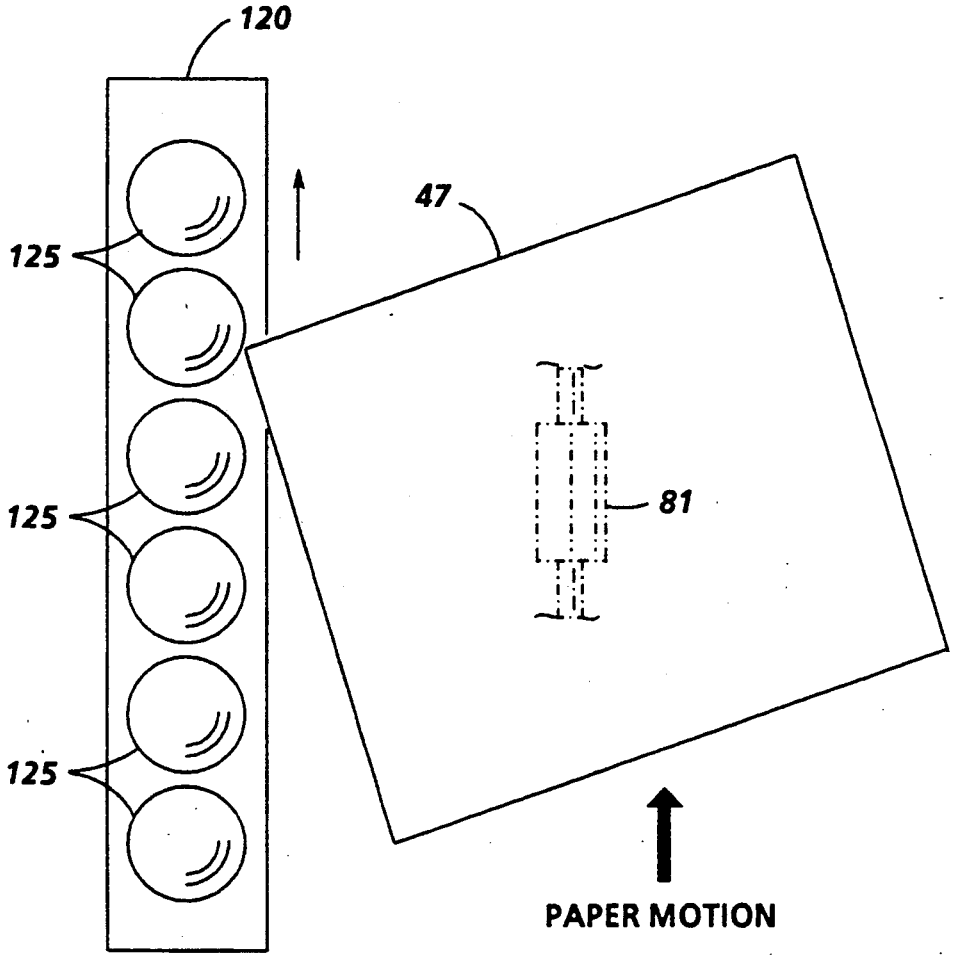
FIG. 3A is a partial top view of an alternative edge guide.

While the moving edge guide of the present invention is disclosed as a belt, it should be understood that other devices could be used as well. For example, dynamic edge guide belt 101 could be replaced by an edge guide comprising rotating rolls or by lightweight, idler rolls as shown in FIG. 3A. With lightweight idler rolls, no drive power is required. The paper simply moves along the freewheeling idler rolls with close to zero relative velocity and, therefore, close to zero friction. In FIG. 3A, idler rolls 125 are supported in support member 120 and are contacted by moving substrate 47. The movement of the substrate by belts 48, 49 and side scuffer 81, 82 causes the idler rolls to rotate, thus making the idler rolls dynamic and at the same time eliminating relative motion between the substrates and the idler rolls and thereby reducing frictional wear of the idler rolls. Alternatively, a belt or other suitable means could be placed under the rolls in the support member in order to rotate them independent of substrates. Also, while the edge guide of the present invention is disclosed in the paper path of a reprographic machine, it is equally well suited for use in document handlers or sheet feeders in general.

In conclusion, a dynamic edge guide for use in a side registration system is disclosed that comprises a moving belt with a channel into which substrates fit. The side edge registration system includes pins secured to drive belts that accept paper from a paper tray. As the paper leaves a nip located downstream of the paper tray, a side scuffer with normal force ball engages the paper and side registers it with the side guide. Subsequently, the pin members located on the belts contact the trail edge of the paper and propels it in synchronism with an image on the photoreceptor toward the transfer zone. Tacking forces in the transfer zone override the paper directional force of fingers 90 and guides the paper through the transfer zone toward fusing station E.

In addition to the method and apparatus disclosed above, other modifications and/or additions will readily appear to those skilled in the art upon reading this disclosure and are intended to be encompassed within the invention disclosed and claimed herein.

I claim:

1. In a copier system having an image processor which forms images on a copy substrate, means for exposing image of documents to said processor, transfer means for transferring the image of the documents from said processor to the copy substrate, and feed means for feeding the copy substrate to said processor, the improvement comprising:

copy substrate registration means for transporting and registering the copy substrate in synchronism with an image produced by said processor including side registration means for driving the copy substrate laterally with respect to the direction of travel of the copy substrate, and edge guide means for receiving and edge registering the copy substrate driven thereinto by said side registration means, and wherein said edge guide means includes a fixedly positioned moving belt which has protrusions thereon that form a channel into which the copy substrate is driven by said side registration means.

2. The improvement of claim 1, including belt backing support means adjacent the substrate contacting portion of said belt.

3. An apparatus for minimizing the jamming and misregistration of substrates into an edge guide, comprising:

transport means for moving a substrate in a predetermined direction;

side registration means for moving the substrate in a direction substantially transverse to said predetermined direction; and fixedly positioned belt means adapted for movement in said predetermined direction and to edge register the substrate driven thereagainst by said side registration means, and wherein said belt means has protrusions thereon that form a channel into which the copy substrate is driven by said side registration means.

4. The improvement of claim 3, including belt backing support means adjacent the substrate contacting portion of said belt means.

5. In a printer system having an image processor which forms images on a substrate, means for transmitting page image of documents to said image processor, transfer means for transferring the images of the documents from said processor to the substrate, and feed means for feeding the substrate to said processor, the improvement comprising:

transport means for moving a substrate in a predetermined direction;

side registration means for moving the substrate laterally; and fixedly positioned edge guide means adapted for movement in said predetermined direction and to allow registration of the substrate thereagainst by said side registration means, and wherein said edge guide means is a rotatable belt and wherein said belt has means thereon that forms a channel into which the copy substrate is driven by said side registration means.

6. The improvement of claim 5, including belt backing support means adjacent the substrate contacting portion of said belt.

7. An apparatus for minimizing the jamming and misregistration of substrates into an edge guide, comprising:

transport means for moving a substrate in a predetermined direction;

side registration means for moving the substrate in a direction substantially transverse to said predetermined direction; and edge guide means fixedly positioned within a vertical plane and adapted for movement in said predetermined direction and to edge register the subtrate driven thereagainst by said side registration means, and wherein said edge guide means is a belt having protrusions thereon that form a channel into which the copy substrate is driven by said side registration means.

8. The improvement of claim 7, including belt backing support means adjacent the substrate contacting portion of said belt means.

* * * * *